United States Patent [19]

Ohba et al.

[11] Patent Number: 5,015,262

[45] Date of Patent: May 14, 1991

[54] DYE-LEVELING AGENT FOR REACTIVE DYEING: PHOSPHOLIPIDS OR PHOSPHOLIPID-TYPE COMPOUNDS

[75] Inventors: Noriaki Ohba; Yujin Tabata; Tateyuki Nagatomi, all of Tokyo, Japan

[73] Assignee: Nihon Surfactant Kogyo K.K., Tokyo, Japan

[21] Appl. No.: 285,857

[22] Filed: Dec. 26, 1988

[51] Int. Cl.[5] ..... D06P 1/66; C09B 62/00

[52] U.S. Cl. ..... 8/543; 8/549; 8/557; 8/558; 8/562; 8/584; 8/589; 8/594; 8/609; 8/918

[58] Field of Search ..... 8/543, 584, 558, 594

[56] References Cited

U.S. PATENT DOCUMENTS

| | | | |
|---|---|---|---|
| 4,439,206 | 3/1984 | Hildebrand et al. | 8/543 |
| 4,515,596 | 5/1985 | Berendt et al. | 8/107 |
| 4,579,559 | 4/1986 | Canela | 8/127.1 |

FOREIGN PATENT DOCUMENTS 8809411 12/1988 PCT Int'l Appl. .

*Primary Examiner*—A. Lionel Clingman

*Attorney, Agent, or Firm*—Flynn, Thiel, Boutell & Tanis

[57] ABSTRACT

Cloth is dyed using a reactive dye, an alkaline substance and a leveling agent. The leveling agent is one or more substances selected from the group consisting of phospholipids obtained from animals or plants, compounds having the formula I and compounds having the formula II:

(I)

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; 1 and m each denote 0 or an integer of at least 1; and M denotes alkali metal or hydrogen, (II)

wherein $R_4$ denotes alkyl, alkenyl, hydroxyalkyl, straight chain, hydroxy-substituted alkenyloxy or branched chain, hydroxy-substituted alkenyloxy; X and Y each denote hydrogen, alkoxy, alkyl, or wherein M denotes alkali metal or hydrogen; and n denotes an integer of at least 1.

11 Claims, 1 Drawing Sheet

DYE-LEVELING AGENT FOR REACTIVE DYEING: PHOSPHOLIPIDS OR PHOSPHOLIPID-TYPE COMPOUNDS

The present invention relates to a leveling agent for reactive dyes. More particularly, it is concerned with a leveling agent which simplifies the sophisticated dyeing process and permits uniform reproducible dyeing with reactive dyes.

Natural fibers vary in their properties depending on locality, climate and other factors, and this makes it difficult to dye natural fibers uniformly with good reproducibility. For this reason, there has been a demand for technology that permits one to control dyeing and reactions at will, especially in the case where reactive dyes are used.

In dyeing with reactive dyes, the rate of dyeing is typically controlled by adding alkaline substances. This dyeing method is required to be performed according to a quadratic curve representing the relationship between the time and the amount of alkali added which is established for individual reactive dyes. Therefore, this dyeing method needs complex controls according to the combination of the dyeing machine, substrate, and reactive dye.

Other known dyeing methods include S.A.S. method and all-in method; but they are useful only for limited combinations of reactive dyes and fibers.

In dyeing with reactive dyes, it is necessary to control the rate of alkali addition and the temperature for each reactive dye because the reactivity and adsorption to fibers differ from one reactive dye to another. Therefore, it is difficult to perform dyeing in the case where reactive dyes having different reactivity are used in combination with one another. On the other hand, natural fibers vary in dyeability depending not only on the kind and locality but also on their chemical treatment such as bleaching. For natural fibers to be dyed uniformly, it is necessary to establish complex conditions for the dyeing steps; and this in turn makes it difficult to maintain good reproducibility and uniform quality.

In summary, the immediate problem to be solved in the dyeing industry is to develop a leveling agent which simplifies the dyeing steps, ensures uniformity and reproducibility of dyeing, permits dyeing with different types of dyes in combination, and reduces the limitations on dyeing conditions for individual fibers and blended products. Such a leveling agent will improve the productivity and cost reduction of dyeing and also increases the versatility of colors that can be selected, which are the most important subjects in the dyeing industry. Unfortunately, no leveling agent has so far been proposed which meets such requirements.

SUMMARY OF THE INVENTION

It is an object of the present invention to provide a leveling agent which solves the above-mentioned problems.

To achieve the above-mentioned object, the present inventors carried out a series of researches which led to the finding that the above-mentioned problems can be solved if dyes are used in combination with the leveling agent of the present invention. The present invention was completed on the basis of this finding.

Accordingly, the present invention relates to a leveling agent for reactive dyes and also to a dyeing method which employs said leveling agent, said leveling agent comprising one or more than one kind of substance selected from phospholipids obtained from animals and plants and/or phospholipid-like compounds represented by the formula (I) or (II).

The invention provides a method for dyeing a cloth with a reactive dye, an alkaline substance and a leveling agent, said leveling agent being selected from the group consisting of phospholipids obtained from animals or plants and phospholipid-like compounds having the formula (I) or (II):

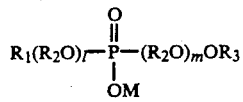

(I)

(where $R_1$ and $R_3$ each denote an alkyl group, alkenyl group, hydroxyalkyl group, or M (but both of them do not denote M simultaneously); $R_2$ denotes an alkylene group having 2 to 4 carbon atoms; l and m each denote 0 or an integer of 1 or above; and M denotes an alkali metal or hydrogen.)

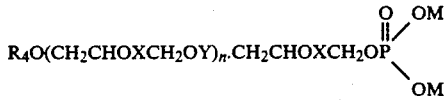

(II)

(where R denotes an alkyl group, alkenyl group, hydroxyalkyl group, or linear or side chain unsaturated OH-containing alkoxy group; X and Y each denote hydrogen, alkoxy group, alkyl group, or phosphate group represented by

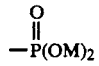

M denotes an alkali metal or hydrogen; and n denotes an integer of 1 or above.)

According to the invention it is possible that the alkaline substance is added to the dyeing solution at a time, without separate addition of divided portions thereof.

The invention further provides a dyeing composition which comprises a reactive dye and a leveling agent as defined above and a dyeing solution which comprises a reactive dye and a leveling agent. The dyeing solution may further comprise an alkaline substance. The dyeing solution may comprise a hydrophilic surfactant and a polycarboxylic acid.

It is preferable that the solution comprises 0.1 to 5 g/l of the leveling agent The solution is intended to include also a dispersion of a dye and one in the form of micelle.

The invention provides a dyeing assistant composition which comprises the leveling agent as defined above and a polycarboxylic acid and which may further comprise a hydrophilic surfactant. Another dyeing assistant composition comprises the leveling agent and a hydrophilic surfactant.

The phospholipids that can be used in the present invention are those which originate from animals or plants. They include oil-containing crude lecithins, purified lecithins, and their hydrogenated products and enzymatically decomposed products. They also include phytic acid. The phospholipid-like substances include alkyl phosphate esters and polyalkyleneoxide alkyl phosphate esters represented by the formula (I) and alkyl polyglycerin ether phosphate ester salt and polyglycerin fatty ester phosphate ester salt represented by the formula (II). These compounds should preferably contain alkyl chains having 8 or more carbon atoms. They can be used as such or in combination with a hydrophilic surface active agent or in the form of liposome-like dispersion.

The leveling agent of the present invention readily disperses or dissolves in water. It produces its effect when added in an amount of 0.1 to 5 g/liter, preferably 0.5 to 3 g/liter.

The leveling agent of the present invention may be incorporated with one or more than one kind of polycarboxylates in addition to the above-mentioned substances. Examples of the polycarboxylates include salts of organic acid such as oxalic acid, maleic acid, and succinic acid, and salts of polymeric carboxylic acids such as polyacrylic acid, carboxymethylcellulose, and polystyrenemaleic acid copolymer.

The leveling agent of the present invention may also be incorporated with one or more than one kind of anionic surface active agent in addition to the above-mentioned substances. Examples of the anionic surface active agent include carboxylates such as fatty acid salts and an alkylpolyethylene glycolether methyl carboxylic acid salt; sulfate ester salts such as alkyl sulfate and polyoxyethylenealkylether sulfate; and sulfonates such as alkylbenzenesulfonate and alkylsufonate.

Furthermore, the leveling agent of the present invention may be used in combination with a polyoxyethylene alkylether-type nonionic surface active agent and a watersoluble alcohol such as ethanol and ethylene glycol, in addition to the above-mentioned substances, for the improvement of mutual dissolution or dispersion into water of the components.

The leveling agent of the present invention is completed by properly selecting and formulating the above-mentioned components according to the kind of dyes used and the dyes' reactivity toward fibers.

The present inventors also found a new dyeing method which, owing to the leveling agent of the present invention, permits uniform dyeing even though an alkaline substance is added all at once. This dyeing method simplifies and shortens the dyeing steps and improves the dyeing productivity.

According to this dyeing method, an alkaline substance is added all at once, as shown in FIG. 1, unlike the conventional dyeing method, in which case an alkaline substance is added in a controlled manner. The amount of an alkaline substance to be added can be increased or decreased according to the reactivity toward fibers of the reactive dye used. Likewise, the reaction time can also be adjusted.

The leveling agent of the present invention makes the following improvements when used in dyeing with reactive dyes.

(1) It permits uniform dyeing with good reproducibility.

(2) It permits an alkaline substance to be added all at once without any adverse effect on the uniformity and reproducibility of dyeing. This simplifies the dyeing steps, making in-process sampling unnecessary and giving more chances of achieving the desired dyeing by a single pass. All this leads to the streamlining and cost reduction of the dyeing process.

(3) It permits simultaneous dyeing and scouring by the one-bath method.

(4) It gives an extremely bright color.

(5) It permits the use of dyes having different reactivities.

In addition to the above-mentioned advantages, the leveling agent of the present invention produces the effect of imparting soft feel and wrinkle resistance to the dyed products. The leveling agent of the present invention is also useful for direct dyes as well as reactive dyes. Moreover, it facilitates the soaping to be performed after dyeing.

The invention will be described with reference to the following examples.

EXAMPLES 1 TO 4 AND COMPARATIVE EXAMPLES 1 TO 4

Figure 1:
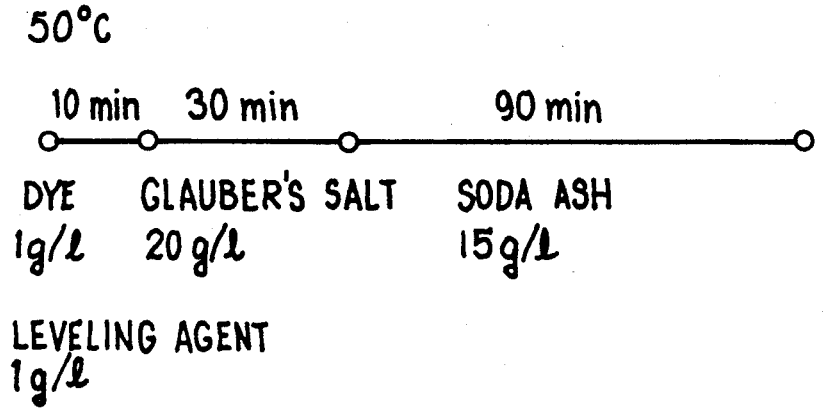
FIGS. 1 and 2 are the dyeing programs used in the present invention.

Dyeing tests were performed according to the dyeing program shown in FIG. 1 by shaking a 500-ml Erlenmyer flask containing a folded sample cloth (100×300 mm) and 75 ml of deionized water, at a constant speed (100 rpm) in a water bath. The results are shown in Table 1.

| Composition A (leveling agent) | |
|---|---|
| Crude soybean lecithin | 30% |
| Sodium polyacrylate | 30% |
| Sodium L-dodecylbenzenesulfonate | 40% |

TABLE 1

| | Dye | Fiber | Composition A | Results |
|---|---|---|---|---|
| Comparative Example 1 | Levafix Blue E-RN | Mercerized cotton | None | Uneven |
| Example 1 | " | Mercerized cotton | 1 g/L | Even |
| Comparative Example 2 | Remazol Rriel. Blue R-KN | Mercerized cotton | None | Uneven |
| Example 2 | Remazol Rriel. Blue R-KN | Mercerized cotton | 1 g/L | Even |
| Comparative Example 3 | Cibacron Red FB | Mercerized cotton | None | Uneven |
| Example 3 | " | Mercerized cotton | 1 g/L | Even |
| Comparative Example 4 | Levafix Yellow E-2RN Levafix Brown E-RN Levafix Blue E-RN | Mercerized cotton | None | Uneven |
| Example 4 | Levafix Yellow E-2RN Levafix Brown E-RN | Mercerized cotton | 1 g/L | Even |

TABLE 1-continued

| Dye | Fiber | Composition A | Results |
|---|---|---|---|
| Levafix Blue E-RN | | | |

EXAMPLES 1 TO 8 AND COMPARATIVE EXAMPLES 5 TO 8

Figure 2:
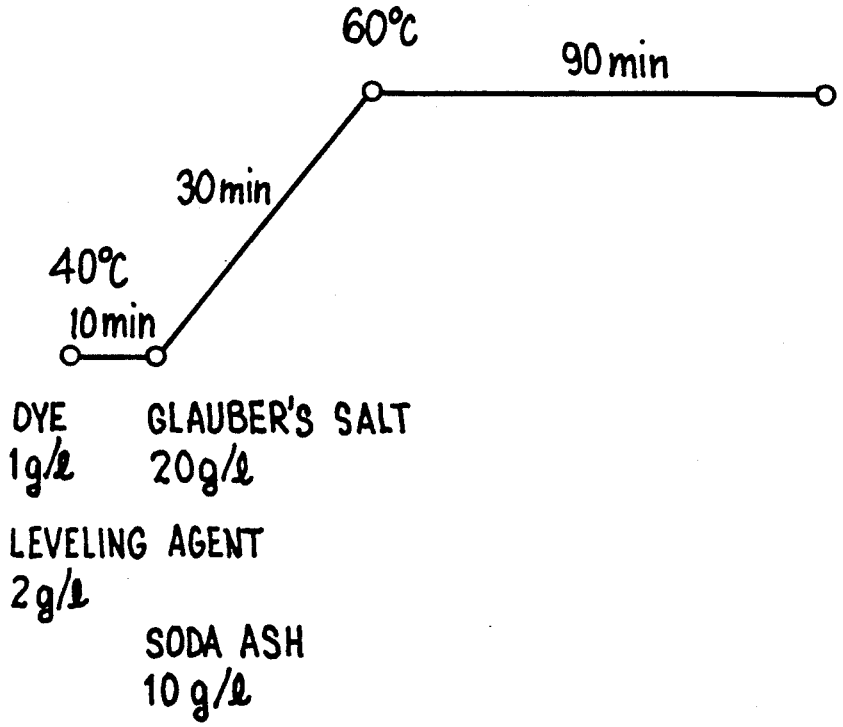

Dyeing tests were performed in the same manner as in Examples 1 to 4 according to the dyeing program shown in FIG. 2. The results are shown in Table 2.

| | |
|---|---|
| Dilaurin phosphate | 20% |
| Sodium polystyrenemaleate | 30% |
| Polyoxyethylenoeleyl ether | 10% |
| Sodium laurylsulfonate | 40% |

TABLE 2

| | Dye | Fiber | Composition A | Results |
|---|---|---|---|---|
| Comparative Example 5 | Levafix Royal Blue E-FR | Mercerized cotton | None | Uneven |
| Example 5 | Levafix Royal Blue E-FR | Mercerized cotton | 2 g/L | Even |
| Comparative Example 6 | Reactive Blue ZE-GN | Linen | None | Uneven |
| Example 6 | Reactive Blue ZE-GN | " | 2 g/L | Even |
| Comparative Example 7 | Sumifix Supra Navy Blue 2GF | Cotton-linen blend | None | Uneven |
| Example 7 | Sumifix Supra Navy Blue 2GF | Cotton-linen blend | 2 g/L | Even |
| Comparative Example 8 | Remazol Black B | Bleached cotton | None | Uneven |
| Example 8 | Remazol Black B | Bleached cotton | 2 g/L | Even |

EXAMPLES 9 TO 13

Dyeing tests were performed in the same manner as in Examples 1 to 4, using Levafix Brown E-RA dye, mercerized cotton, and leveling agents shown in Table 3. The results are shown in Table 3.

TABLE 3

| Example No. | 9 | 10 | 11 | 12 | 13 |
|---|---|---|---|---|---|
| Soybean lecithin | 10 | — | — | — | 60 |
| Na laurylglycerylether phosphate | 10 | 20 | 60 | 60 | 1 |
| Sodium polyacrylate | 40 | — | — | 40 | — |
| Sodium carboxymethylcellulose | — | 20 | 40 | — | — |
| Polyoxyethylene (20 mol) soybean oil | 20 | 10 | — | — | 40 |
| Sodium laurate | 20 | 50 | — | — | — |
| Results | Even | Even | Even | Even | Even |

We claim:

1. A method for dyeing a cloth which is capable of being dyed with a reactive dye, which comprises contacting said cloth with a dyeing solution comprising a reactive dye, an alkaline substance and a leveling agent, said leveling agent being selected from the group consisting of phospholipids obtained from animals or plants, compounds having the formula I and compounds having the formula II:

$$R_1(R_2O)_l-\overset{\overset{O}{\|}}{\underset{\underset{OM}{|}}{P}}-(R_2O)_mOR_3 \quad \text{(I)}$$

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; l and m each denote O or an integer of at least 1; and M denotes alkali metal or hydrogen, $$R_4O(CH_2CHOXCH_2OY)_n.CH_2CHOXCH_2O\overset{\overset{O}{\|}}{P}\begin{matrix}/OM\\ \backslash OM\end{matrix} \quad \text{(II)}$$

wherein $R_4$ denotes alkyl, alkenyl, hydroxyalkyl, straight chain, hydroxy-substituted alkenyloxy or branched chain, hydroxy-substituted alkenyloxy; X and Y each denote hydrogen, alkoxy, alkyl, or $$-\overset{\overset{O}{\|}}{P}(OM)_2$$

wherein M denotes alkali metal or hydrogen; and n denotes an integer of at least 1.

2. A method as claimed in claim 1, in which the alkaline substance is added to the dyeing solution at one time.

3. A dyeing composition which comprises a reactive dye and a leveling agent selected from the group consisting of phospholipids obtained from animals or plants, compounds having the formula I and compounds having the formula II:

(I)

$$R_1(R_2O)_l-\overset{\overset{O}{\|}}{\underset{\underset{OM}{|}}{P}}-(R_2O)_mOR_3$$

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; l and m each denote O or an integer of at least 1; and M denotes alkali metal or hydrogen,

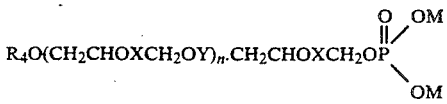

(II)

wherein $R_4$ denotes alkyl, alkenyl, hydroxyalkyl, straight chain, hydroxy-substituted alkenyloxy or branched chain, hydroxy-substituted alkenyloxy; X and Y each denote hydrogen, alkoxy, alkyl, or

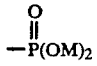

wherein M denotes alkali metal or hydrogen; and n denotes an integer of at least 1.

4. A dyeing solution which comprises a reactive dye and a leveling agent selected from the group consisting of phospholipids obtained from animals or plants, compounds having the formula I and compounds having the formula II:

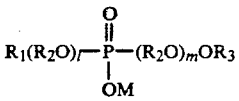

(I)

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; l and m each denote O or an integer of at least 1; and M denotes alkali metal or hydrogen,

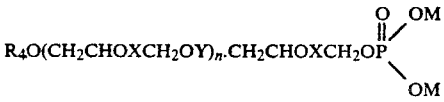

(II)

wherein $R_4$ denotes alkyl, alkenyl, hydroxyalkyl, straight chain, hydroxy-substituted alkenyloxy or branched chain, hydroxy-hydroxy-substituted alkenyloxy; X and Y each denote hydrogen, alkoxy, alkyl, or

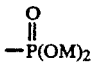

wherein M denotes alkali metal or hydrogen; and n denotes an integer of at least 1.

5. A dyeing solution as claimed in claim 4, which further comprises an alkaline substance.

6. A dyeing solution as claimed in claim 5, which further comprises a hydrophilic surfactant.

7. A dyeing solution as claimed in claim 6, which further comprises a polycarboxylic acid.

8. A dyeing solution as claimed in claim 4, which comprises 0.1 to 5 g/l of the leveling agent.

9. A dyeing assistant composition which comprises a leveling agent selected from the group consisting of phospholipids obtained from animals or plants, compounds having the formula I and compounds having the formula II:

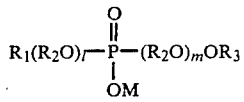

(I)

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; l and m each denote O or an integer of at least 1; and M denotes alkali metal or hydrogen,

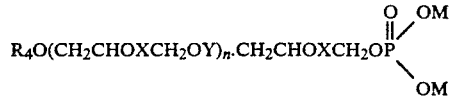

(II)

wherein $R_4$ denotes alkyl, alkenyl, hydroxyalkyl, straight chain, hydroxy-substituted alkenyloxy or branched chain, hydroxy-substituted alkenyloxy; X and Y each denote hydrogen, alkoxy, alkyl, or

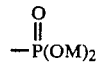

wherein M denotes alkali metal or hydrogen; and n denotes an integer of at least 1 and a polycarboxylic acid.

10. A dyeing assistant composition as claimed in claim 9, which further comprises a hydrophilic surfactant.

11. A dyeing assistant composition which comprises a leveling agent selected from the group consisting of phospholipids obtained from animals or plants, compounds having the formula I and compounds having the formula II:

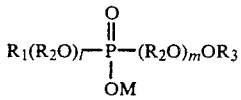

(I)

wherein $R_1$ and $R_3$ each denotes alkyl, alkenyl, hydroxyalkyl, or M, with the proviso that both of $R_1$ and $R_3$ are not M simultaneously; $R_2$ denotes alkylene having 2 to 4 carbon atoms; l and m each denote O or an integer of at least 1; and M denotes alkali metal or hydrogen,

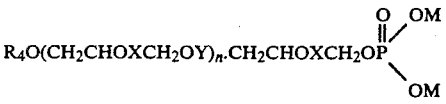

(II)

wherein $R_4$ denotes alkyl, alkenyl, hydroxyalkyl, straight chain, hydroxy-substituted alkenyloxy or branched chain, hydroxy-substituted alkenyloxy; X and Y each denote hydrogen, alkoxy, alkyl, or

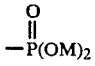

wherein M denotes alkali metal or hydrogen; and n denotes an integer of at least 1 and a hydrophilic surfactant.

* * * * *

UNITED STATES PATENT AND TRADEMARK OFFICE

CERTIFICATE OF CORRECTION

PATENT NO. : 5,015,262

DATED : May 14, 1991

INVENTOR(S) : Noriaki OHBA et al

It is certified that error appears in the above-identified patent and that said Letters Patent is hereby corrected as shown below:

On the title page at item [22], change the date to read as follows: ---December 16, 1988---.

Signed and Sealed this

Fifth Day of January, 1993

*Attest:*

DOUGLAS B. COMER

*Attesting Officer*

*Acting Commissioner of Patents and Trademarks*